US006988711B2

(12) United States Patent
Skach

(10) Patent No.: US 6,988,711 B2
(45) **Date of Patent: *Jan. 24, 2006**

(54) UNIVERSAL PRY BAR

(75) Inventor: Joseph R. Skach, Tigard, OR (US)

(73) Assignee: Max Force Systems, LLC, Tigard, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/064,696

(22) Filed: Feb. 22, 2005

(65) Prior Publication Data

US 2005/0173685 A1 Aug. 11, 2005

Related U.S. Application Data

(63) Continuation of application No. 10/777,278, filed on Feb. 11, 2004, now Pat. No. 6,913,246.

(51) Int. Cl.
*B66F 15/00* (2006.01)

(52) U.S. Cl. ..... 254/25; 254/131

(58) Field of Classification Search ..... 254/25, 254/20, 18, 131.1, 131.5
See application file for complete search history.

(56) References Cited

U.S. PATENT DOCUMENTS

| | | | | |
|---|---|---|---|---|
| 888,841 | A * | 5/1908 | Naudain | 254/25 |
| 900,338 | A | 10/1908 | Wolfe | |
| 1,317,156 | A | 9/1919 | Diamond | |
| 1,329,458 | A | 2/1920 | Cobb | |
| 1,410,801 | A | 3/1922 | Erickson | |
| 3,288,437 | A | 11/1966 | Pederson | |
| 5,749,113 | A | 5/1998 | Witter | |
| 5,938,177 | A | 8/1999 | Fonda | |
| 6,105,935 | A * | 8/2000 | Wagner | 254/21 |
| D431,990 | S | 10/2000 | Hyslop et al. | |
| 6,186,479 | B1 | 2/2001 | Witter | |
| 6,505,817 | B1 | 1/2003 | Witter | |
| 6,715,734 | B1 | 4/2004 | Wise | |
| 6,767,003 | B1 * | 7/2004 | Toensing | 254/25 |
| 2004/0069978 | A1 | 4/2004 | Whelan | |

* cited by examiner

*Primary Examiner*—Lee D. Wilson
(74) *Attorney, Agent, or Firm*—Schwabe, Williamson & Wyatt

(57) ABSTRACT

A pry bar tool having independent components, including a fulcrum, multiple and different handles, and multiple bar ends. The handles and bar ends are selectively and releasably attachable to the fulcrum to accommodate different pry bar tasks.

5 Claims, 2 Drawing Sheets

UNIVERSAL PRY BAR

RELATED APPLICATION

This is a continuation of U.S. patent application Ser. No. 10/777,278 entitled "Universal Pry Bar" filed on Feb. 11, 2004 now U.S. Pat. No. 6,913,246.

FIELD OF THE INVENTION

This invention relates to a tool commonly used in construction and/or demolition, generically referred to as a pry bar, and more particularly it relates to an assembly of components that can be interchangeably assembled to customize the tool to a variety of tasks.

BACKGROUND OF INVENTION

A pry bar in accordance with the present invention includes a bar end portion, a fulcrum portion and a handle portion. The bar end portion typically (but not necessarily) has a flat leading edge that can be inserted under a member secured to a support, e.g. a to-be-removed floorboard fastened to an under-flooring. A heel or fulcrum portion is located rearward of the leading edge and a handle portion extends rearwardly and upwardly from the heel or fulcrum portion. The tool user forces the flat leading edge under, e.g. the floorboard and forces pivotal movement of the handle about the fulcrum to raise the leading edge. Typically, a first pry motion as described produces partial raising of the board edge to permit the user to further insert the leading edge and further raise the board. A user becomes proficient in the procedure and with a couple of repeats (insert and pry) will accomplish the task of detaching the board from the under-flooring.

The above explanation is one of many tasks suitable for the pry bar and the tasks range from a delicate removal task to a task demanding substantial brute force. To accommodate these tasks in the past, either the user carried a number of pry bars or made due with a pry bar of mid-range size.

BRIEF DESCRIPTION OF THE INVENTION

It is an objective of the present invention to provide an assembly of tool components that can be discriminately assembled together to selectively construct any of a variety of different pry bars to accommodate a variety of pry bar tasks.

In a preferred embodiment, the three individual components are the handle, the fulcrum and the bar end. The fulcrum may be a single item of, e.g. a half-moon configuration. The rounded bottom provides the abutment surface and the flat top is configured to receive a bar end. The bar end has a flat, straight body portion that engages a substantial length of the flat top and is secured to the flat top with multiple screws seated in threaded holes in the flat surface. The bar end protrudes beyond one end of the fulcrum with the protruded end shaped to provide e.g. a tapered/flared end tip for insertion under a member to be pried. In an alternate embodiment the threaded holes are extended along the flat top and the bar end can be adjusted to protrude different lengths beyond the end of the fulcrum.

At the end of the fulcrum opposite the bar end, an enlarged threaded opening is provided, the axis of which is angled relative to the flat top. The enlarged threaded opening removably receives e.g. a cylindrical handle. Further, as may be desired, the fulcrum may be provided with a flat rear end provided below the handle to enable the user to assist the initial insertion step by applying a hammering force. In this latter event, the structure of the fulcrum may require a stronger material.

As assembled, the three components make up a pry bar configuration that is designed with a wider range of prying motions and amplified prying forces due at least in part to the strategic size and location of the fulcrum. Where added leverage is desired, the handle can be replaced with a longer handle. Where a different bar end tip is desired, the bar end can be replaced with a substitute bar end of desired end tip configuration.

With e.g. three handle lengths and e.g. four or more bar end types, a great latitude in pry bar tasks can be accommodated. Still further, the use can be expanded with different sizes of fulcrums to enable the configuration of even a greater variety of pry bar configurations.

The invention will be more fully appreciated upon reference to the following detailed description and drawings.

DETAILED DESCRIPTION

Figure 1:
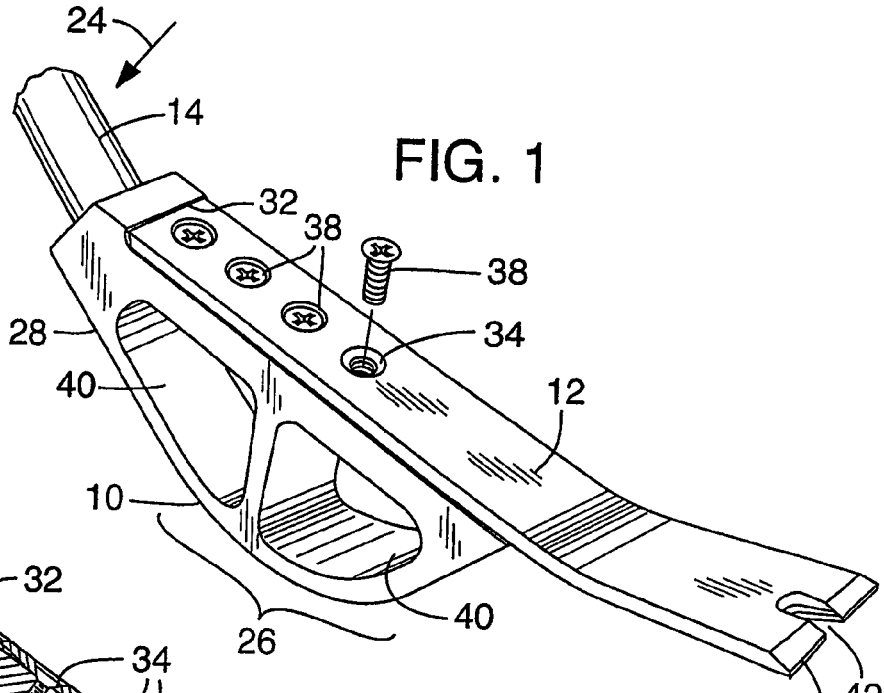
FIG. 1 illustrates in perspective a pry bar assembly in accordance with the invention.
Figure 2:
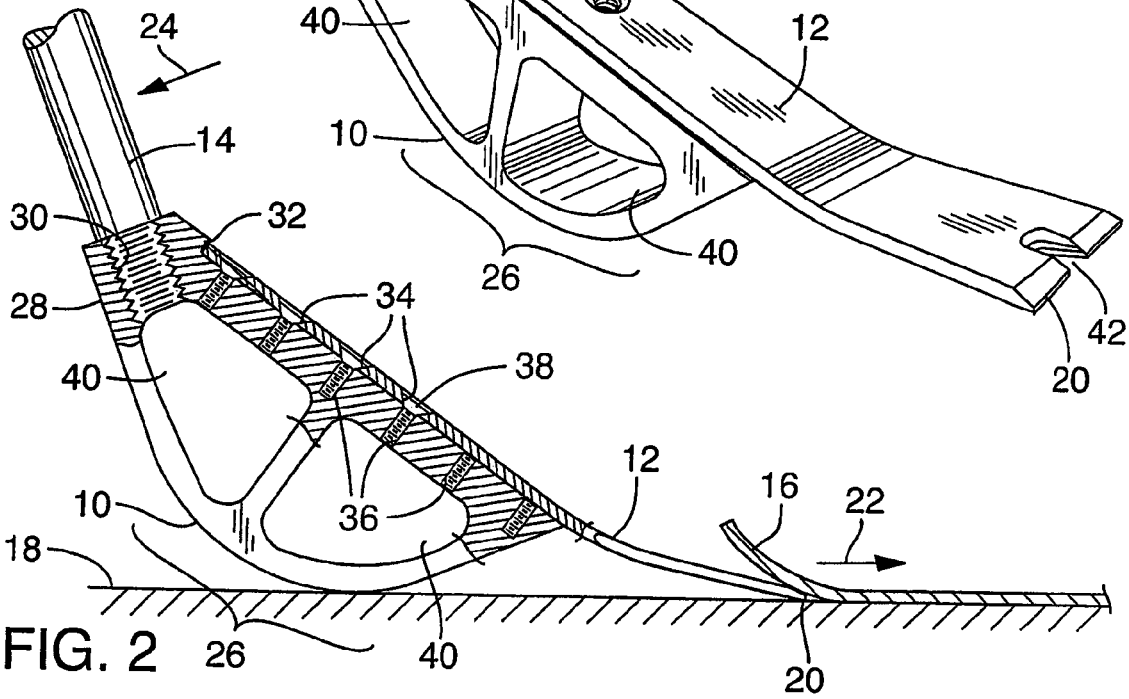
FIG. 2 is a side view of the pry bar of FIG. 1, partially in section, and shown in use for prying e.g. a board from a sub-flooring.

FIGS. 1 and 2 illustrate a pry bar of the present invention which includes a fulcrum 10, a bar end 12 and a handle 14. As illustrated in FIG. 2, the pry bar is being used to pry loose a board 16 secured as by nailing, gluing, etc. to a sub-flooring 18. As is typical for such use, the tool user first places the sharpened end tip 20 of the bar end 12 at the juncture between board 16 and sub-flooring 18. The tool is initially shoved under the edge of the board (arrow 22) as permitted by the tightness of the board to the sub-flooring. The handle is then forced down (arrow 24) which typically pries the board edge up enough to insert the bar further under the board (again, arrow 22) followed by substantial raising and loosening of the board 16 from the sub-flooring. It will be noted that the projected tip of the bar end is angled relative to the main body portion to present a flat orientation of the tip for this insertion procedure.

The above is an example only of but one type of use for the tool/pry bar. The tool is usable in many different ways and many different orientations. For example, it may be used to strip ceiling tiles from overhead, pry up heavy beams to permit a fork lift to slide under, or roll a large cylinder out of the way. The uses of such a pry bar are endless and the criteria is that the bar end, fulcrum and handle are arranged to enable the bar end tip to fit under the object to be pried, the fulcrum contact point positioned sufficiently close and in contact with a support, the bar end configured so as to enable the bar end tip to slide under the object, and with the handle sufficiently extended from the fulcrum to allow the user to apply a desired force to enable the user's leveraged force (arrow 24) to achieve raising of the object.

As generally explained above, there are substantial variables depending on the use to be made of the tool. For "lighter" tasks, a lighter, more compact pry bar utilizing the shorter handle will be desired. For heavier tasks, a pry bar having a longer handle which provides greater leverage will be desired. When working overhead or prying off of the floor, i.e. removing tiles, a longer reach and thus longer handle may be desired, etc.

To accommodate these task variables, the present invention enables conversion from a short handle to a longer handle and/or conversion from a narrow bar end tip to a wider bar end tip and/or conversion to a different bar end type. Still further, the bar end can be shifted relative to the fulcrum, thus enabling deeper penetration under the object to be pryed.

Figure 3:
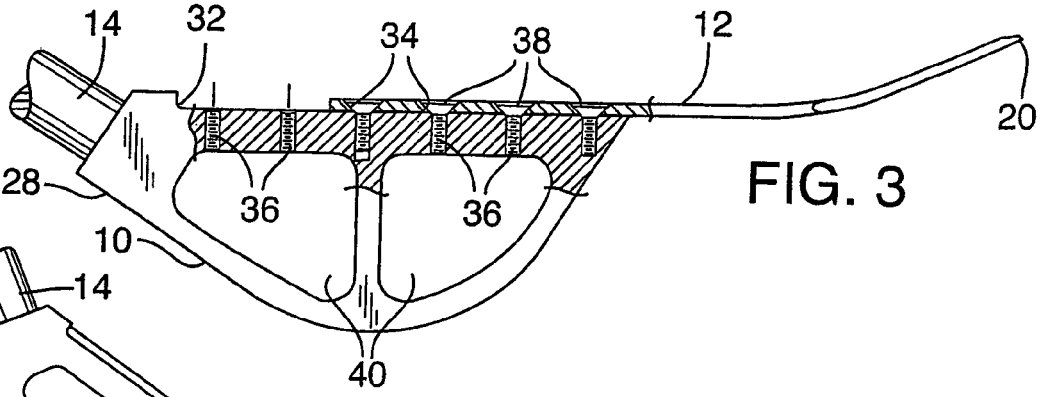
FIG. 3 illustrates the tool of FIG. 2 in an alternate state of assembly.

FIGS. 2–9 illustrate a conversion process of a preferred embodiment of the invention. As shown in FIGS. 2 and 3, the fulcrum component 10 has a curved bottom 26 that serves as the pivotal or engagement surface of the tool (see FIG. 2 where engagement with sub-flooring 18 is indicated). A rear end 28 has a threaded opening 30 for receiving a tubular handle 14. The upper side of the fulcrum has a notch 32 that is configured to receive various ones of the bar ends 12, 12', 12", 12'" (see FIGS. 7–9).

It will be noted from FIG. 2 that the notch configuration allows a lesser thickness underlying the bar end 12 while providing a greater wall thickness surrounding the opening 30. This accommodates the desire for lesser weight but without sacrificing strength where desired, e.g., surrounding the threaded opening 30. With reference to the bar ends 12, 12', etc. of FIGS. 5–9, they are provided with openings 34 that match up with the threaded holes 36 in the fulcrum 10. As will be observed with reference to FIGS. 2, 3, 5 and 6 there may be more threaded holes 36 than the number of openings 34 provided in the bar end 12, i.e. four holding screws 38 may be adequate for holding the bar end 12 but the greater number of threaded holes 36 allows the same bar end to be shifted outwardly as indicated in FIG. 3, i.e. the openings 34 are matched up with the outer-most threaded openings 36.

Figure 2A:
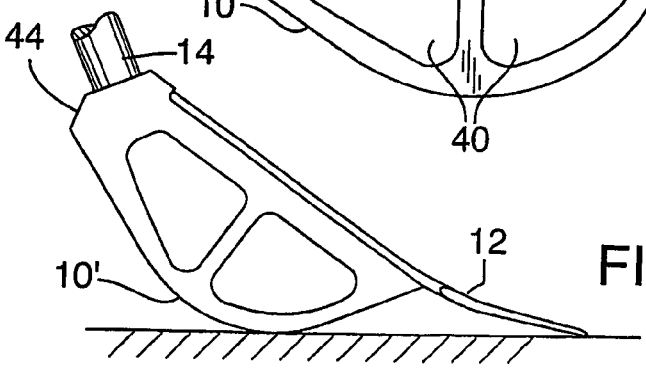
FIG. 2A illustrates a modification that enables hammering of the fulcrum.
Figure 4:
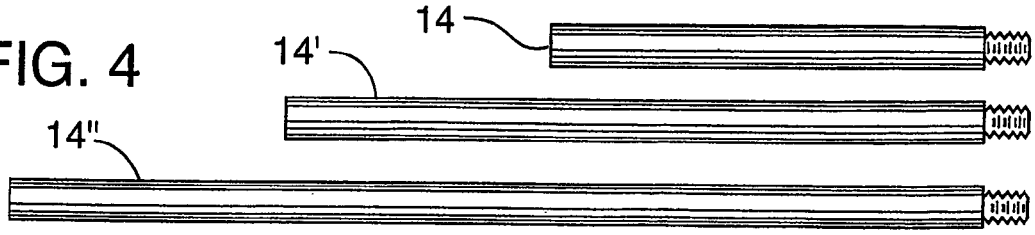
FIG. 4 shows a variety of handles for use with the tool of FIGS. 1–3.
Figure 5:
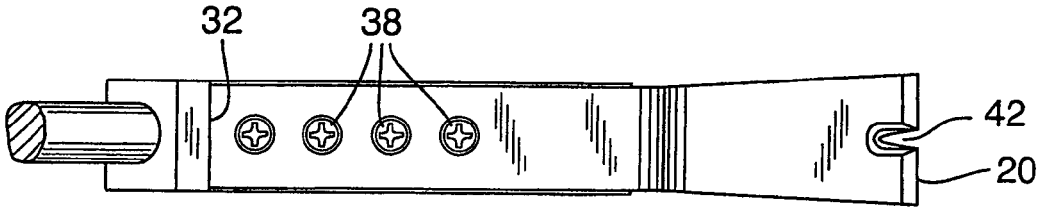
FIGS. 5 and 6 are top views of the tools as shown in FIGS. 2 and 3.
Figure 6:
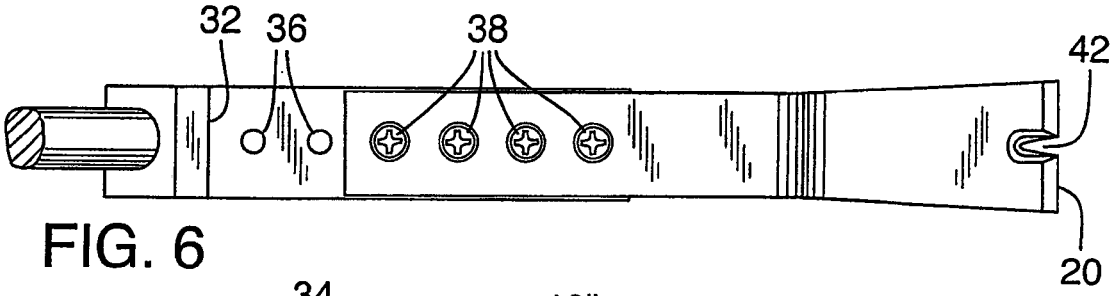

Whereas with all hand tools weight is a consideration, it is preferred that the fulcrum 10 be composed of a strong but light-weight metal e.g. aluminum, with further lightening of the weight provided by the openings 40. Should the tool be intended for hammering, i.e., striking a flat surface 44 in the alternate fulcrum structure 10' of FIG. 2A, it may be desired to thicken the web sections or make the fulcrum from a stronger material.

Many advantages are provided by a tool assembly as illustrated. A composite of handle, fulcrum and bar end is lighter than traditional pry bars and therefore easier to handle. It is more versatile in the tasks it can perform i.e. with rapid re-assembly options, and can adapt to many different uses. Among them is the ability to use a short handled pry bar when desirable and quickly connect to a longer handle when a longer reach for greater leverage is desirable The half moon shaped fulcrum provides a greater range of motion of the handle (arrow 24) which conveys a greater movement to the bar end 20 (compare FIGS. 2 and 3.) The ability to swap out or move the bar end on the fulcrum enables the pry bar to be set up for close in, more rapid removal tasks e.g. for the lighter tasks, but also enabling a set up for greater applied force for the heavier tasks. The simplicity of the assembly and re-assembly enables the user to accommodate multiple tasks with greater efficiency.

The pry bar, when fully assembled with a smaller handle, can fit into the same tool loops as designed for hammers and the like. The tool is easier to maneuver when standing on a ladder and because the handles are rapidly interchangeable, a user can adapt a tool to accommodate many different situations, e.g. to avoid having to stoop over when one can stand with a longer handle, or use a shorter handle to fit into tight spaces, etc.

In general, the pry bar tool can be easily and quickly replaced with a different pry bar end/or handle, creating a multi-usable tool for such varied work tasks as removal of cement, roof tiles, linoleum, plywood, beams, etc. Again, the variables are endless. For example note the provision of the crevice 42 on the bar ends 12 for pulling nails, staples, etc.

Whereas the above explanation illustrates a number of variables, many additional variables will become apparent to those skilled in the art. Accordingly, the claims are intended to encompass all such variables and the terms used are to be given their common understanding and meaning.

What is claimed is:

1. A fulcrum for assisting in performing prying tasks comprising:

a bottom having a portion of which is curved to allow pivotal movement of the fulcrum about a surface;

a rearward end adapted to allow releasable interconnection of one or more handles with the fulcrum; and an upper portion adapted to releasably engage one or more pry bar ends independent of said releasable interconnection for the one or more handles.

2. The fulcrum of claim 1, wherein the upper portion has a substantially flat surface and one or more threaded fastener receiving holes adapted to releasably couple the one or more pry bar ends to the fulcrum.

3. The fulcrum of claim 1, wherein the fulcrum has one or more inner areas where material has been removed to reduce the weight of the fulcrum while leaving other areas solid to provide sufficient structural support.

4. A fulcrum for assisting in performing prying tasks comprising:

a bottom having a portion of which is curved to allow pivotal movement of the fulcrum about a surface;

a rearward end adapted to allow releasable interconnection of one or more handles with the fulcrum;

an upper portion adapted to releasably engage one or more pry bar ends; and said rearward end having a threaded portion adapted to threadably engage a correspondingly threaded end portion of the one or more handles.

5. A pry bar tool assembly for performing pry bar tasks comprising:

a fulcrum, one or more bar ends having one or more bar end tips to allow for different pry bar usage, and one or more handles, said fulcrum configured to have a curved bottom surface, an upper portion having a front end, and a rear end;

said one or more handles adapted to releasably and replaceably connect to the rear end of the fulcrum and extend rearwardly from said rear end to allow for different pry bar leverage, and the one or more bar ends having a connection opposite said bar end tips that are releasably coupled to the upper portion and extended forward of the front end of said fulcrum whereby said one or more bar ends and one or more handles can be selectively and independently assembled and reassembled to said fulcrum to provide different pry bar tool configurations.

* * * * *

UNITED STATES PATENT AND TRADEMARK OFFICE

CERTIFICATE OF CORRECTION

Figure 7:
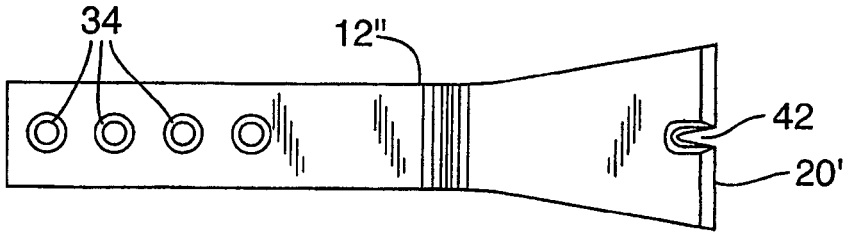
FIGS. 7–9 illustrate different bar ends for the tools of FIGS. 1–3.
Figure 8:
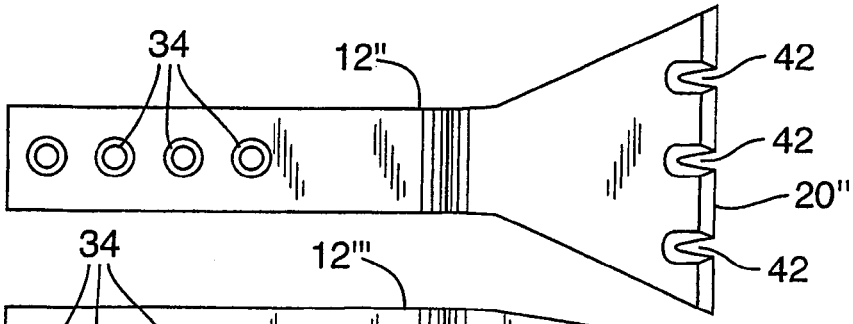
Figure 9:
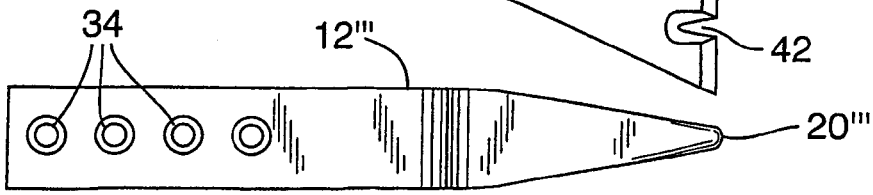

PATENT NO. : 6,988,711 B2
APPLICATION NO. : 11/064696
DATED : January 24, 2006
INVENTOR(S) : Skach It is certified that error appears in the above-identified patent and that said Letters Patent is hereby corrected as shown below:

Figure 7
Reference numeral “ 12” should read --12’--.

Column 1
Line 40, “...made due...” should read --...made do...--.

Column 4
Line 31, “...one or more threaded fastener...” should read --...one or more threaded fasteners...--.

Signed and Sealed this

Twelfth Day of June, 2007

JON W. DUDAS
*Director of the United States Patent and Trademark Office*